US005251945A

United States Patent [19]

Stoops

[11] Patent Number: 5,251,945

[45] Date of Patent: Oct. 12, 1993

[54] DEVICE FOR PROTECTING AND TRANSPORTING ARTICLES

[75] Inventor: Kevin R. Stoops, Springfield, Mo.

[73] Assignee: Innovative Technologies, Inc., Springfield, Mo.

[21] Appl. No.: 839,849

[22] Filed: Feb. 21, 1992

[51] Int. Cl.[5] ..... B65D 37/00

[52] U.S. Cl. ..... 294/152; 294/165

[58] Field of Search ..... 294/138, 149, 150, 152, 294/157, 165; 224/151, 908; 150/154, 165; 190/107

[56] References Cited

U.S. PATENT DOCUMENTS

| | | | |
|---|---|---|---|
| 473,540 | 4/1892 | Wheeler | 294/152 X |
| 712,137 | 10/1902 | Jackson | 294/150 X |
| 841,902 | 1/1907 | Shumaid | 294/150 X |
| 1,373,136 | 3/1921 | Kranz | 294/152 X |
| 1,904,532 | 4/1933 | Reiss | 294/138 X |
| 1,904,729 | 4/1933 | Hancock et al. | 294/152 X |
| 2,175,387 | 10/1939 | Goding | 294/152 X |
| 2,784,890 | 3/1957 | Chisholm | 294/152 |
| 3,024,824 | 3/1962 | Bass . | |
| 3,312,263 | 4/1967 | Wahlstrom | 294/149 X |
| 4,423,834 | 1/1984 | Rush | 224/151 |
| 4,489,815 | 12/1984 | Martinez . | |
| 4,620,396 | 11/1986 | Bjorntwedt . | |
| 4,745,769 | 5/1988 | Wooden . | |
| 4,881,684 | 11/1989 | Chinman . | |
| 4,958,759 | 9/1990 | Jarvis | 294/138 X |
| 4,984,906 | 1/1991 | Little . | |

*Primary Examiner*—David M. Mitchell
*Assistant Examiner*—Dean J. Kramer
*Attorney, Agent, or Firm*—Kokjer, Kircher, Bowman & Johnson

[57] ABSTRACT

A device for the protection and assistance in manual transportation of bulky articles. The device includes a main panel which is elongated in a first direction. The article to be carried may be placed at the longitudinal center of the main panel and the longitudinal ends thereof brought upwardly about the article. Straps with appropriate fasteners are provided on the main panel to maintain the longitudinal ends in this upward configuration about the article. To aid in the manual transport of the device and enclosed article, a pair of handles, one on each longitudinal end of the main panel, may be readily grasped by the user. To protect the article against moisture and electrical shock, it is preferably formed of a waterproof and electrically insulating material. Additionally, the device may include a top flap along one longitudinal end. Side flaps may be provided at each lateral edge extending from the longitudinal end containing the top flap to a point beyond the longitudinal center of the main panel. These flaps will serve to surround the enclosed article for further protection.

10 Claims, 1 Drawing Sheet

DEVICE FOR PROTECTING AND TRANSPORTING ARTICLES

BACKGROUND OF THE INVENTION

1. Field of the Invention

The present invention relates in general to devices for supporting articles for manual transport. In particular, the present invention relates to an improved device for protecting and facilitating the manual transport of bulky electronics, such as monitors, central processing units, etc.

2. Description of the Related Art

The use of electronic equipment such as electronic cash registers, personal computers, printers and other equipment has increased dramatically, with a proportional increase in the repair of such items. Due to their complicated nature, on-site repair of such items is often not feasible. In such situations, the repair technician must then physically transport the faulty item to the repair shop.

While such items typically have a weight such that they may be manually lifted, such items are often of a sufficient weight and bulk that they cannot be lifted and carried with a single hand. Additionally, such items are subject to damage by mechanical and electrical shock, and by moisture. It is therefore necessary for the repair technician to make several trips between the work site and his or her vehicle to retrieve all tools and faulty items, with the items being subject to damage during their transport to the vehicle.

Similar problems with transporting the items are know in the sales aspect of this industry.

SUMMARY OF THE INVENTION

An object of the present invention is to provide a device which will allow a bulky and somewhat heavy article, such as an electronic device, to be carried manually in a single hand of the user.

Another object of the present invention is to provide such a device which is of a small physical size and weight when not in use.

Yet another object of the present invention is to provide such a device which will provide protection for the carried article against moisture, mechanical and/or electrical shock.

These and other objects are achieved by a device for the protection and assistance in manual transportation of bulky articles. The device includes a main panel which is elongated in a first direction. The article to be carried ma be placed at the longitudinal center of the main panel and the longitudinal ends thereof brought upwardly about the article. Straps with appropriate fasteners are provided on the main panel to maintain the longitudinal ends in this upward configuration about the article. To aid in the manual transport of the device and enclosed article, a pair of handles, one on each longitudinal end of the main panel, may be readily grasped by the user. To protect the article against moisture and electrical shock, it is preferably formed of a waterproof and electrically insulating material. Additionally, the device may include a top flap along one longitudinal end. Side flaps may be provided at each lateral edge extending from the longitudinal end containing the top flap to a point beyond the longitudinal center of the main panel. These flaps will serve to surround the enclosed article for further protection.

BRIEF DESCRIPTION OF THE DRAWINGS

The objects and features of the invention noted above are explained in more detail with reference to the drawings in which like reference numerals denote like elements, and in which.

DETAILED DESCRIPTION OF THE INVENTION

Figure 1:
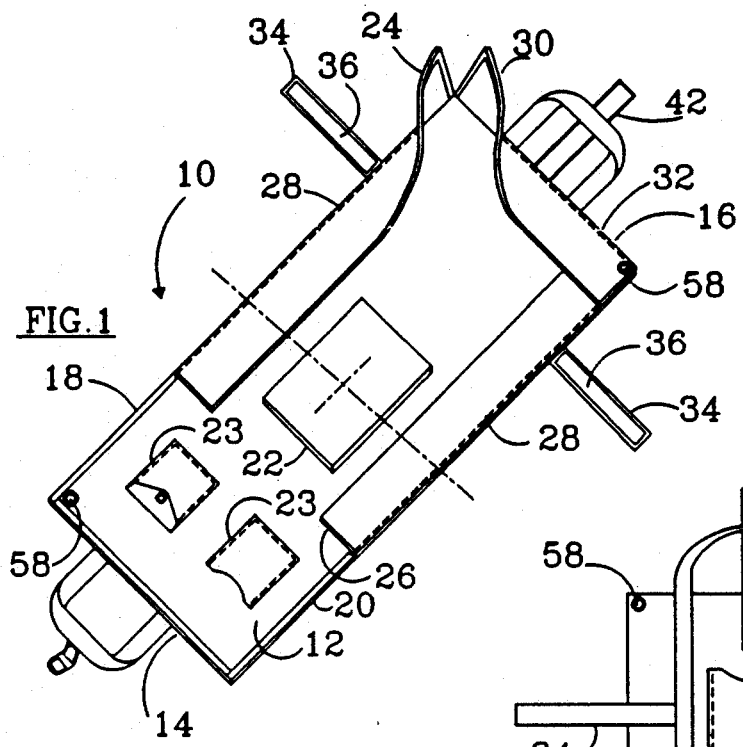
FIG. 1 is a perspective view of the device according to the present invention in the open position.

With reference to FIG. 1, the device according to the present invention is generally designated by reference numeral 10. The device 10 includes a main panel 12 which is elongated to define first and second longitudinal ends 16 and 14 and first and second lateral side edges 18 and 20. Although the main panel may of course be of any desired size, a preferred embodiment forms the longitudinal ends with a length of 66 centimeters (26 inches), and the lateral side edges at approximately 120 centimeters (47 inches).

The main panel 12 is formed of a at least semi-flaccid material such that it may be easily wrapped about the exterior of an article to be carried within the device 10. As will become apparent from later discussion, it is preferred that such an article be placed at a central location on the main panel 12 prior to being enclosed within the device. To facilitate this the main panel may be provided with some type of indicator, such as a cross printed upon the main panel at the appropriate location, or in a similar manner through the use of stitching on the main panel. Alternatively, the main panel 12 may be provided with a central pad 22 having its center substantially corresponding to the center of the main panel 12. Due to the smaller size of the central pad 22, the user will more readily identify the center of the central pad, and thus the main panel.

The central pad 22 may advantageously be formed of a resilient material such as silicone foam which will help to cushion and protect the article carried within the device 10. In such instances it may be preferred to form the central pad such that it extends to the lateral side edges of the main panel 12.

Connected to each of the lateral side edges 18 and 20 is an at least semi-flaccid side panel, respectively designated first side panel 24 and second side panel 26. These side panels are placed upon the main panel in an overlying manner and the opposing faces of the main panel and side panels are connected together adjacent and along the lateral side edges of the main panel.

This is an important feature of the present invention, as this type of connection will tend to force the side panels into their overlying relationship on the main panel. While the connection between the main panel and side panels could be formed in many ways, such as by adhesives, it is preferred that the main panel and side panels are formed from a single monolithic piece of material with the side panels being folded inwardly and appropriate stitching 28 passing through the side panel and main panel parallel and adjacent to each of the lateral side edges of the main panel.

The side panels will serve as additional protection for the article carried within the device. As such, the side panels should extend for a sufficient distance to provide sufficient protection. To aid in preventing the ingress of water and dirt into the device during operation, and to prevent loose pieces of the article carried within the device from falling therefrom, it is preferred that the side panels at least extend a distance on either side of the longitudinal center of the main panel 12. This will ensure that the side panels are located towards the bottom of the device when in the operative position. Additionally, forming the side panels longer than is strictly necessary to meet such goals will provide additional protection against mechanical shock and moisture ingress. While various lengths are thus possible, a preferred arrangement is to extend the side panels from the first longitudinal end 16 to a distance (for example approximately 17 cm (6.5")) past the longitudinal center of the main panel 12. This arrangement will provide sufficient protection for the carried article while using the minimal amount of material.

The device 10 is also provided with a top flap 30. The top flap is formed in a manner similar to the first and second side panels, and as such is preferably formed as an integral part of the material forming the main panel 12 which is folded over and stitched at 32 to aid in maintaining the top flap in the overlying position upon the main panel 12. It is noted that the stitching 32 is effected such that the top flap 30 will preferably additionally overly a portion of the side panels 24 and 26.

The particular material employed for the main panel 12, and preferably the side panels and top flaps, is a tough light-weight fabric having a waterproof coating or property. For example, rip-stop nylon impregnated with a coating of latex or similar material will provide the required properties. It is also preferable if the coating employed to water proof-the material (or the material itself) has the property of blocking, and preferably reducing, static electricity. This is preferred for the extra protection this will afford when the device is used with electronic devices. To provide further protection against mechanical shock, the material may include a layer of foam bonded thereto which may eliminate the need for a central pad 22.

While various sizes could of course be employed, preferable sizes for the side flaps are approximately 76 centimeters (30 inches) in the longitudinal direction by 18 centimeters (7 inches) in the lateral direction. The top flap 30 is preferably approximately 18 centimeters (7 inches) in the longitudinal direction and has a width corresponding to that of main panel 12.

To provide separate storage for small items associated with the article to be carried, the device may include one or more pockets, such as inner pocket 23 on the inner face of the main panel and/or outer pocket 23' on the outer face. These pockets may be formed of a material similar to that used for the main panel. It may be advantageous to provide some or all of these pockets with closure flaps, which may include releasable fastening means.

To aid in maintaining the device in a position wrapped about an article, the device includes fastening means. While various arrangements could be employed, a preferred arrangement is to provide a pair of main straps 34 extending laterally outwardly from the lateral side edges of the main panel at a point on an outer face 40 of the main panel which is spaced from the longitudinal center. As is best shown in FIG. 4, the main straps 34 may thus extend about the article within the device to be connected to the main panel at a position spaced from the point at which the straps are permanently connected.

While various arrangements may be employed to releasably fix the free end of the main straps to the main panel, such as buckles or snaps, it is preferred to employ a hook and loop fastening system by providing hook portions 36 along the length of the main straps 34 and by providing a pair of patches 38 of loop material on the outer face 40 of the main panel 12. As may be readily seen, the patches 38 should be spaced from the longitudinal center of the main panel 12 by a distance corresponding to the spacing of the main straps 34 from this longitudinal center. It is also noted that the use of hook portions 36 along the entire length of the main straps 34 will allow the device to accommodate articles of varying sizes.

Figure 4:
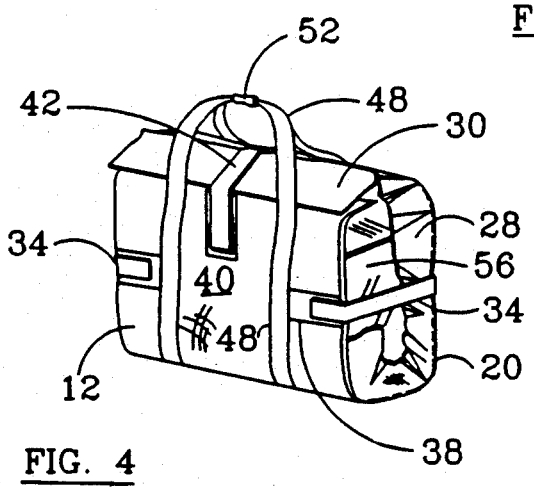
FIG. 4 is a perspective view of the device in the closed position.

To provide additional aid in maintaining the device in the assembled condition of FIG. 4, there is also provided a fastening means associated with the top flap 30. In particular, a top strap 42 extends outwardly from the second longitudinal end 14 in a longitudinal direction at substantially the lateral center of the main panel 12. In a manner similar to the main straps 34, the top strap 42 is preferably provided with a hook portion 44 which may releasably engage with a patch 46 of loop material located on the bottom face 40 of the main panel 12 at a position adjacent the first longitudinal end 16. As is best shown in FIG. 4, in the operative position, the top strap 42 will extend across the top flap 30 to engage with the patch 46 This will maintain the top flap in position to protect the article within the device.

To aid in the manual transport of the device and article, the device 10 is provided with handle straps 48. Each of the handle straps 48 is connected adjacent to a longitudinal end of the main panel 12 on the bottom face 40 thereof. The handle straps are connected to the main panel at a position spaced from the longitudinal ends such that the longitudinal ends may wrap about and cover and protect the article within the device even when lifting pressure is applied to the handle straps 48.

To provide additional support, it is preferred that the handle straps 48 are formed as a single strip of material which forms a loop elongated in the longitudinal direction of the main panel. The majority of this strip of material is fixed to the bottom face 40 of the main panel, as by stitching, to prevent this strip of material from catching upon objects. Where the handle straps are formed from the single strip of material, there will of necessity be a pair of ends of this material which must be abutted to form the elongated loop. For aesthetic reasons it is preferred that this overlap take place substantially at the longitudinal center of the main panel 12 such that it is less visible.

Figure 2:
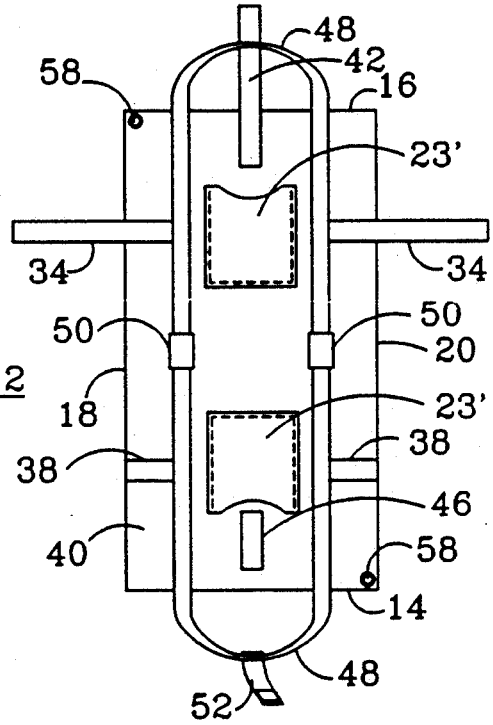
FIG. 2 is a bottom view of the device in an open position.
Figure 3:
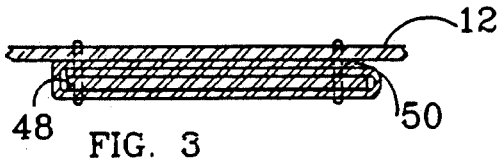
FIG. 3 is a cross-sectional detail view taken along line 3—3 of FIG. 2.

The device 10 may also be provided with support feet 50, which are best shown in FIGS. 2 and 3. The support feet 50 are preferably formed of a length of the same type of material used to form the main panel 12, and which is folded about handle strap 48 several times to have a lateral width approaching that of the handle straps 48, and is located substantially at the longitudinal center of the main panel. The support feet are then fixed to the bottom face 40 of the main panel in covering relation to the handle straps at a location substantially corresponding to the longitudinal center of the main panel. The use of support feet 50 will provide some support in this central area against bending. The main advantage of the support feet 50, however, is the additional cushion provided at the location where the article will rest upon the floor. It is also noted that the use of the support feet may cover the overlap of the material forming the handle straps, further increasing the aesthetics of the device.

It is preferred, though not required, that the same material is used to form the main straps 34, top strap 42 and handle straps 48. This material ma be high strength nylon webbing, particularly of the type used commonly for seat belts.

As a convenience to the user, one of the free loops of the handle strap, such as that adjacent longitudinal end 14, may be provided with a tie strap 52. This tie strap will be formed of the same material as handle straps 48, or it may be formed of a material providing more cushion, such as leather. In any event, the tie strap 52 will be at least substantially flaccid and have a first end connected to such handle strap 48. The tie strap will be adapted to wrap about the other handle strap 48 when the device is in the assembled condition of FIG. 4. The tie strap 52 will include an appropriate releasable fastener, such as hook and loop type, such that the tie strap may be releasably fixed to itself to maintain the handles in their assembled condition. As such, the tie strap will maintain the handles in a convenient arrangement for grasping, and may additionally provide additional cushioning to improve the user's comfort.

The device of the present invention is shown in operative position in FIG. 4. As may be readily seen, this device provides a protective covering for an article 56 within the device. Additionally, the handle straps will allow the user to carry the device, and thus the article, with at most one hand. FIG. 4 also shows an important feature of the present invention, which is the tendency of the side panels and top flap to move toward the overlying position on the main panel (FIG. I). This tendency will ensure that these elements rest against the article, protecting same, rather than falling outwardly with respect to the device in FIG. 4, which would be the result if the side panels and top flap were connected in any other way.

When the device 10 is not in use it may be folded at the longitudinal center (with the top flap and side panels tucked inside) and rolled from this fold line to form a compact and easily stored package. It is noted that the placement of the side panels and top flap in the proper position for rolling is again facilitated by their tendency toward the overlying relation.

While the above invention has been described with regard to a particular embodiment, it should be apparent to those in the art that various modifications could be made. For example, the handle straps could be increased in length such that the handle straps may be supported on a user's shoulder. Alternatively, the main panel may be provided with eyelets 58 at diagonally opposite corners (or all corners) to allow attachment of a separate shoulder strap, similar to luggage. Care should be taken with such eyelets that the side panels are not restricted in their upward motion. Additionally, the number and placement of the main straps and top straps could be varied.

From the foregoing it will be seen that this invention is one well adapted to attain all ends and objects hereinabove set forth together with the other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative, and not in a limiting sense.

What is claimed is:

1. A device for aiding in manually transporting articles, comprising:

a main panel formed of at least substantially flaccid material and being elongated in a first direction to define a longitudinal axis, longitudinal ends and lateral side edges, whereby an article may be placed upon said main panel and said longitudinal ends brought upwardly to at least partially encompass the article;

a pair of at least substantially faccid side panels adapted to additionally partially encompass the article, said side panels being movably disposed in overlying relation on said main panel with each said side panel having a peripheral edge substantially aligned with an associated one of said lateral edges of said main panel and a face opposed to an inner face of said main panel, said respective faces of said side panels being connected to said inner face of said main panel along a line substantially parallel to, and in proximity to, said associated lateral edges of said main panel, whereby said side panels tend toward said overlying relation;

two main straps, each connected to said main panel at a point and having a free end extending beyond the periphery of said main panel;

means for releasably fixing each said strap to said main panel at a position spaced from said point, each said point and each said position being on an outer face of said main panel, and each said point being in proximity to a respective one of said lateral side edges; and at least one handle connected to said main panel and adapted to be supported by a user.

2. A device as in claim 1, further including a top flap disposed in overlying relation on said main panel with said top flap having a peripheral edge substantially aligned with a first one of said longitudinal end of said main panel and a face opposed to said inner face of said main panel, said face of said top flap being connected to said inner face of said main panel along a line substantially parallel to, and in proximity to, said first longitudinal end of said main panel, whereby said top flap tends toward said overlying relation yet may be placed in an overlying relation to the second one of said longitudinal ends when said ends have been brought upwardly to partially encompass the article.

3. A device as in claim 2, wherein said main panel, side panels, and top flap are all formed from a single monolithic piece of said material, and wherein at least a portion of said lateral side edges are defined by a fold line between said main panel and each said side flaps, and at least a portion of said first longitudinal end is defined by a fold line between said main panel and said top flap.

4. A device as in claim 1, further comprising a top strap mounted on said outer face of said main panel in proximity to said first longitudinal end and having a free end extending outwardly therefrom substantially in said direct direction, and means for releasably fixing said free end of said top strap to said outer face of said main panel in proximity to said second longitudinal end.

5. A device as in claim 4, wherein said means for fixing said main straps and said top strap includes hook and loop fasteners, one of said hook and said loop being mounted on the respective one of said straps and the other of said hook and said loop being mounted at said positions and in proximity to said second longitudinal end.

6. A device for aiding in manually transporting articles, comprising:

a main panel formed of at least substantially flaccid material and being elongated in a first direction to define a longitudinal axis, a longitudinal center, longitudinal ends and lateral side edges, whereby an article may be placed upon said main panel and said longitudinal ends brought upwardly to at least partially encompass the article;

a pair of at least substantially flaccid side panels adapted to additionally partially encompass the article, each said side panel having a peripheral edge substantially aligned with and connected to an associated one of said lateral edges of said main panel and extending from a first end in proximity to a first one of said longitudinal ends of said main panel to a second end beyond said longitudinal center and spaced from a second one of said longitudinal ends of said main panel, each said side panel being movably disposed in overlying relation on said main panel and having a face opposed to an inner face of said main panel, said respective faces of said side panels being connected to said inner face of said main panel along a line substantially parallel to, and in proximity to, said associated lateral edges of said main panel, whereby said side panels tend toward said overlying relation;

two main straps, each connected to said main panel at a point and having a free end extending beyond the periphery of said main panel;

means for releasably fixing each said strap to said main panel at a position spaced from said point, each said point and each said position being on an outer face of said main panel, and each said point being in proximity to a respective one of said lateral side edges; and at least one handle connected to said main panel and adapted to be supported by a user.

7. A device as in claim 6, further including a top flap disposed in overlying relation on said main panel with said top flap having a peripheral edge substantially aligned with a first one of said longitudinal end of said main panel and a face opposed to said inner face of said main panel, said face of said top flap being connected to said inner face of said main panel along a line substantially parallel to, and in proximity to, said first longitudinal end of said main panel, whereby said top flap tends toward said overlying relation yet may be placed in an overlying relation to the second one of said longitudinal ends when said ends have been brought upwardly to partially encompass the article.

8. A device as in claim 7, wherein said main panel, side panels, and top flap are all formed from a single monolithic piece of said material, and wherein at least a portion of said lateral side edges are defined by a fold line between said main panel and each said side flaps, and at least a portion of said first longitudinal end is defined by a fold line between said main panel and said top flap.

9. A device as in claim 6, further comprising a top strap mounted on said outer face of said main panel in proximity to said first longitudinal end and having a free end extending outwardly therefrom substantially in said first direction, and means for releasably fixing said free end of said top strap to said outer face of said main panel in proximity to said second longitudinal end.

10. A device as in claim 9, wherein said means for fixing said main straps and said top strap includes hook and loop fasteners, one of said hook and said loop being mounted on the respective one of said straps and the other of said hook and said loop being mounted at said positions and in proximity to said second longitudinal end.

* * * * *